United States Patent [19]

Okada et al.

[11] Patent Number: 4,571,765

[45] Date of Patent: Feb. 25, 1986

[54] METHOD OF AND APPARATUS FOR THERMALLY TREATING FIBER YARNS

[75] Inventors: Tokio Okada; Shigezo Kojima, both of Tokyo; Haruhisa Tani, Tokorozawa, all of Japan

[73] Assignees: Polymer Processing Research Institute, Ltd., Tokyo, Japan; The Bouligny Company, Charlotte, N.C.

[21] Appl. No.: 638,364

[22] Filed: Aug. 7, 1984

[30] Foreign Application Priority Data

Aug. 10, 1983 [JP] Japan ..... 58-145954

[51] Int. Cl.[4] ..... D06B 3/02; D06B 23/04; D06B 23/18

[52] U.S. Cl. ..... 8/149.3; 28/266; 68/5 E

[58] Field of Search ..... 8/149.2, 149.3; 68/5 D, 68/5 E; 28/266; 34/212, 216; 432/8, 59

[56] References Cited

U.S. PATENT DOCUMENTS

| | | | |
|---|---|---|---|
| 2,060,634 | 11/1936 | Otis | 432/59 |
| 2,838,420 | 6/1958 | Valente | 34/216 X |
| 3,763,527 | 10/1973 | Yazawa | 28/266 |
| 4,286,394 | 9/1981 | Gort | 34/216 X |
| 4,299,036 | 11/1981 | Schregenberger | 34/216 X |

FOREIGN PATENT DOCUMENTS

| | | | |
|---|---|---|---|
| 2701726 | 8/1977 | Fed. Rep. of Germany | 34/212 |

*Primary Examiner*—Philip R. Coe

*Attorney, Agent, or Firm*—Bucknam and Archer

[57] ABSTRACT

A bundle of fibers fed from a stuffer box longitudinally in a corrugated form is wrapped with a breathable heat resistant fabric to form a continuous belt-like shape and then introduced into and drawn out of a thermal treatment region by the aid of inlet and outlet ducts and guide channel in a heat-treatment chamber into which is supplied a heating medium comprising one of non-condensable gas, superheated steam, and a mixture of said non-condensable gas and said superheated steam. The chamber includes a high-pressure portion and a low-pressure portion disposed on opposite sides of the guide channel. The heating medium flows longitudinally along the inlet and outlet ducts in opposite directions towards outsides and transversely from the high-pressure portion to the low-pressure portion across the guide channel, whereby the fibers wrapped with the breathable heat resistant fabric is thermally treated. The heating medium used for the thermal treatment is recirculated into the high-pressure portion after having been pressurized and heated.

9 Claims, 11 Drawing Figures

METHOD OF AND APPARATUS FOR THERMALLY TREATING FIBER YARNS

BACKGROUND OF THE INVENTION

1. Field of the Invention

The present invention relates to a tension-free continuous thermal treatment of fibers, and more particularly to a method of and an apparatus for carrying out such thermal treatment of fibers.

2. Prior Art

In the manufacture of synthetic fibers, it is a general practice that fibers having been spun from a polymer are drawn and then subjected to a thermal treatment to become stable against deformation when they are subjected to various subsequent treatments. In general, the fibers shrink while being heat treated. As a usual thermal treatment, the bundle of fibers is made to pass through continuously touching the surface of heated roll or heated stationary surface. In the above continuous method, it is impossible to keep the fibers in a state free from tension. Accordingly even the fibers while have been already heat-treated in the above way, tend to shrink to same extent when warmed upto the same temperature as that of the previous treatment. For the purpose of heat treating the fibers while being kept completely free from tension, there is another method in which the fibers are kept in an autoclave free from any stress during the heat treatment. This method is batch process and cannot be operated continuously.

The U.S. Pat. No. 3,763,527 issued on Oct. 9, 1973 which is assigned to the present assignee, discloses one such tension-free continuous thermal treatment. According to the disclosed treatment, the bundle of fibers withdrawn from a stuffer box in crimped or corrugated form is wrapped with a breathable heat resistant textile fabric and then passes through a heat-treatment chamber into which saturated steam of a temperature above 100° C. is supplied under pressure to heat set the crimped fibers. The fibers are not bound lengthwise while being heat-treated, so that the fibers can shrink freely. The heat-treatment chamber has an inlet duct serving as a pressure seal within which saturated steam flows in a direction opposite to the direction of the movement of the fiber to expel air from spaces between the fiber to the outside of the heat-treatment chamber. So the steam distributes to all of the interspace among the fibers, the saturated steam occupying the inter-fiber spaces gives its latent heat to the fibers and condenses. The condensation of the preceding steam enables penetration of the succeeding steam and facilitates a continuous heat exchange between the saturated steam and the fibers with the result that the fibers are effectively treated in a relatively short period of time under tension-free conditions.

The above continuous method has proven to have unsatisfactory points. Namely: In the case where the treating temperature is high, the pressure of the saturated steam is also high, accordingly the mechanism of the inlet and outlet ducts must be complicated. Furthermore for keeping good sealing in the inlet and outlet ducts, the special type of crimper is required to keep the uniform shape of the cake withdrawn from a stuffer box. Usually fibers to be treated include water, of which steam is also required and condenses for heating up. Accordingly the heating medium turns to be mixture of steam and water. The quantity of the included water is not always uniform along the bundle of fibers, and the distribution of the component of the heating medium is not always uniform. This non-uniformity sometimes tends to cause non-uniformity of the effect of heat-treatment.

SUMMARY OF THE INVENTION

It is therefore an object of the present invention to provide a method and an apparatus for thermally treating fibers uniformly and efficiently under no-load or tension-free conditions using non-condensable gas such as air, superheated steam or a mixture of them, not containing water as a liquid, as a heating medium, in which state the humidity in the fibers is only that remains in equilibrium with the steam in the heating medium. In this case the heating-up of the fibers depends on the heat transmission from the medium of its sensible heat. Therefore to carry out the heat-treatment uniformly, it is necessary for enough quantity of the heating medium to flow through the fibers. The pressurized chamber is used to keep the pressure difference in the heat-treatment chamber for making the medium flow through stably.

According to the present invention, a bundle of continuous fibers fed from a stuffer box longitudinally in a corrugated form is wrapped with a breathable heat resistant fabric to form a continuous belt of cake. The belt is introduced into a thermal treatment region or guide channel in a heat-treatment chamber into which is supplied a heating medium comprising one of non-condensable gas such as air, superheated steam, and a mixture of said non-condensable gas and said superheated steam. The fibers are introduced into and drawn out of the heat-treatment chamber through the inlet and outlet ducts by the aid of the wrapping fabric without being affected by any tensile force, and while staying in the chamber heated up by the flowing through of the heating medium.

The rate of steam in the heating medium has much influence on the proceeding of heating effect on the fiber. In general for getting the same heating effect, higher temperature is necessary in the case where steam ratio is lower. Accordingly to put the process of the present invention in operation effectively, it is necessary to keep the ratio of the components of the heating medium constant. Furthermore the heating medium heats up the fibers by its sensible heat, and steam ratio tends to change to be in equilibrium state with the humidity contained in fiber. Therefore as above explained, the heating medium should be supplied to flow through the fibers amply for the purpose of getting uniform heat treatment.

The advantage of the present invention is excellent uniformity of the heat-effect on the fibers. Other advantages are as follows: In the case where the material of the fibers is easy to decompose and change its color by high temperature treatment, by using steam or the mixture of steam the effective temperature for heat-setting is usually lowered and the heat-treatment without fear of coloring can be operated. Usually the effective temperature is higher to some extent, in the case where the superheated steam is used as the heating medium, than in the case where the saturated steam is used. However as operational pressure any convenient pressure may be selected. Therefore the complicated mechanism is not necessary for the sealing of the inlet and outlet ducts, and as far as it folds the fibers into the cake of nearly constant shape. The fibers taken out after heat-treatment contains little humidity. The process of after drying is not necessary, or only slight drying may be enough.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF-DESCRIPTION OF THE DRAWINGS

DETAILED DESCRIPTION

Figure 1:
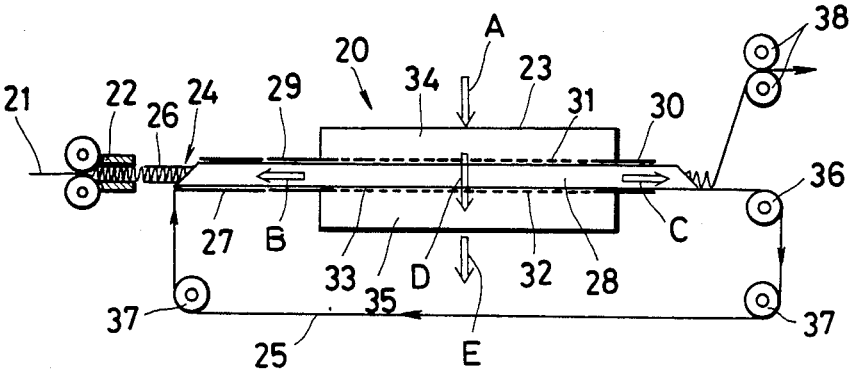
FIG. 1 is a schematic longitudinal cross-sectional view of a thermal treatment apparatus connected to a conventional stuffer box at a downstream position thereof, the view being explanative of a method according to the present invention.

Identical or like parts are denoted by identical or like reference characters throughout the views.

Referring to the drawings and FIG. 1 in particular, there is shown an apparatus 20 constructed in accordance with the present invention for thermally treating fibers 21 which have been withdrawn from a stuffer box 22 in crimped or corrugated form.

The apparatus 20 comprises an elongate heat-treatment chamber 23 into which a heating medium is supplied under pressure, and a wrapping unit 24 disposed between the stuffer box 22 and the heat-treatment chamber 23 for wrapping the cake of the corrugated fibers 21 with a breathable heat resistant fabric 25 before the fibers 21 are introduced into the heat-treatment chamber 23.

Figure 3:
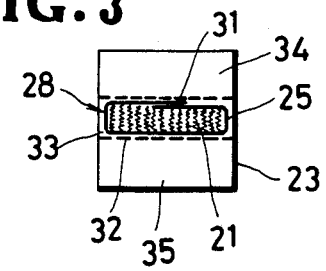
FIG. 3 is a schematic side-elevational view of the apparatus shown in FIG. 2, the view showing fibers wrapped into a breathable heat resistant fabric.
Figure 4:
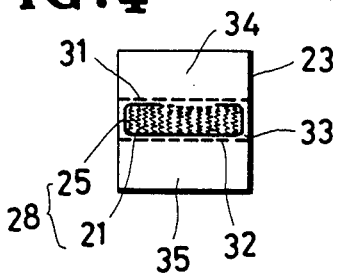
FIG. 4 is a view similar to FIG. 3, showing another form of wrapping of the fibers.

The wrapping unit 24 comprises a double tube constituted by an inner tube 26 of a rectangular cross section and an outer tube 27 surrounding the inner tube 26, there being defined between the inner and outer tubes 26, 27 a narrow annular space for the passage therethrough of the fabric 25. When introduced into the annular space, the fabric 25 is folded over the inner tube 26 through which the cake of the corrugated fibers 21 pass. Thus, the fibers 21 are wrapped with the fabric 25 as they are fed through the wrapping unit 24. The fibers 21 wrapped with the fabric 25 forms a continuous belt-like shape web 28 having a rectangular cross section, as shown in FIGS. 3 and 4.

The heat-treatment chamber 23 includes a pair of inlet and outlet ducts 29, 30 projecting outwardly from opposite ends of the chamber 23 to form pressure seals, respectively, the ducts 29, 30 having a rectangular cross section substantially the same as or slightly larger than the cross section of the belt-like shaped object 28. The heat-treatment chamber 23 further includes a pair of parallel spaced partition walls 31, 32 connected at respective opposite ends with the inner ends of ducts 29, 30 to define therebetween a guide channel 33 for the passage of the belt-like shaped object 28. The partition walls 31, 32 are made of perforated plates or wire nets and divide the interior space of the heat-treatment chamber 23 into a high-pressure portion 34 and a low-pressure portion 35 that are disposed on opposite sides of the guide channel 33 and held in fluid communication with each other.

The breathable heat resistant fabric 25 is in the shape of an endless belt trained around a drive roller 36 and guide rollers 37 in such a manner that the endless fabric belt 25 runs through the wrapping unit 24 and the chamber's guide channel 33 while wrapping the fibers 21. When the belt-like shaped object 28 is discharged from the outlet duct 30 of the heat-treatment chamber 23, the fabric belt 25 becomes flat to thereby unwrap the thermally treated fibers 21. The fibers 21 thus unwrapped are withdrawn by a pair of withdrawal rollers 38 and then wound around a bobbin or fed into a can (not shown).

The heating medium includes non-condensable gases such as dry air, superheated steam, or a mixture of the non-condensable gases and the superheated steam. The heating medium is heated at a suitable temperature and supplied under pressure into the high-pressure portion 34 of the heat-treatment chamber 23, as indicated by the arrow A in FIG. 1. A portion of the supplied heating medium flows through the perforated partition wall 31 into the guide channel 33 and then through the breathable heat resistant fabric 25 into the belt of cake 28. A part of heating medium passes longitudinally through the belt of cake 28 in opposite directions as indicated by the arrows B, C in FIG. 1 and is discharged from the heat-treatment chamber 23 through the inlet and outlet ducts 29, 30. As indicated by the arrow D in this figure, the remaining portion of the heating medium flows from the high-pressure chamber 34 into the low-pressure chamber 35 across the belt of cake 28 due to pressure differences created between the chambers 34, 35, thus providing an increased heating efficiency. The heating medium is discharged from the chamber 23 as indicated by the arrow E.

Figure 2:
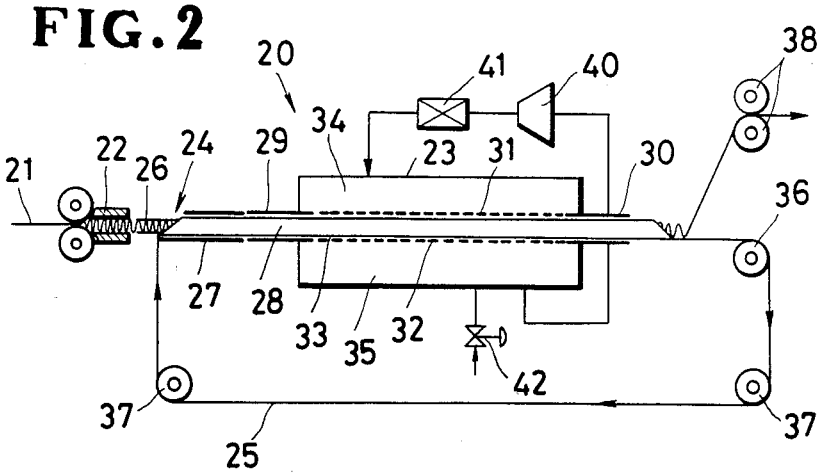
FIG. 2 is a schematic longitudinal cross-sectional view of an apparatus according an embodiment of the present invention.

Preferably, the apparatus 20 includes, as shown in FIG. 2, a heat-reclaiming system for recovering and utilizing heat energy and medium gas discharged after the treatment of the fibers 21 so as to reduce the total energy consumption required to treat the fibers 21.

The reclaiming system comprises a pressurizing unit 40 held in fluid communication with the low-pressure portion 35 of the chamber 23, and a heater 41 connected in series with the pressurizing unit 40 and the high-pressure portion 34 of the chamber 23. With this arrangement, the heating medium discharged from the low-pressure chamber 35 is pressurized at a desired pressure by means of the pressurizing unit 40, then heated at a desired temperature by the heater 41, and finally supplied into the high-pressure portion 34. The reference numeral 42 denotes a control valve for controlling the amount of heating medium which is supplied into the low-pressure portion 35 of the chamber 23 to make up a loss of heating medium discharged from the chamber 23 through the ducts 29, 30.

Figure 5:
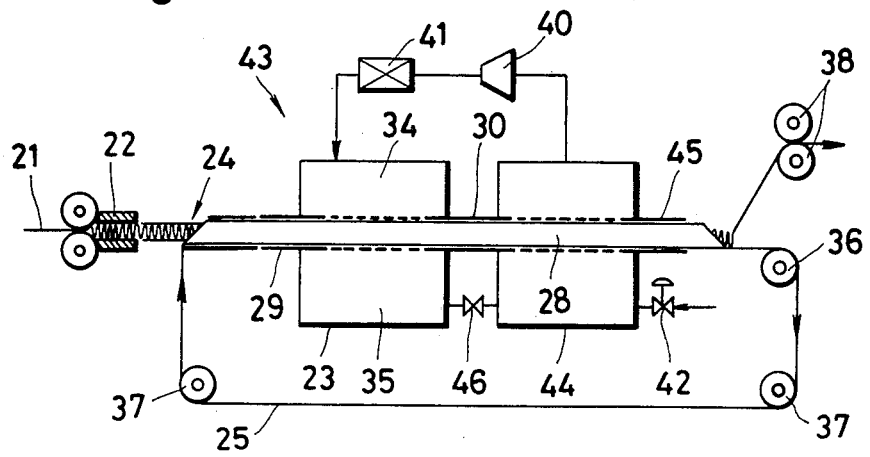
FIG. 5 is a schematic longitudinal cross-sectional view of an apparatus according to another embodiment of the present invention.

A modified apparatus 43 shown in FIG. 5 is similar to the apparatus 20 of FIG. 2 with the exception that the heat-treatment chamber 23 is connected with a low-pressure treatment chamber 44 by means of the outlet duct 30 of the chamber 23, the duct 30 serving as a connector duct. The low pressure treatment chamber 44 is not separated by the channel 33. The heating medium which flows through the outlet duct 30 into the chamber 44 keeps high temperature. The purpose of the chamber 44 is to recover this hot medium. The duct 45 is for preventing the flowing of the outside air into the chamber 44. The low-pressure portion 35 of the chamber 23 is held in fluid communication with the chamber 44 by means of an orifice 46 while the high-pressure portion 34 of the chamber 23 is held in fluid communication with the chamber 44 via the pressurizing unit 40 and the heater 41.

A part of the heating medium leaks out through the inlet and outlet ducts 29, 30. Depending on the difference of the water that is carried in with the fibers and that is carried out with the leakage of the heating medium, the quantity of water remaining in the heat treatment chamber varies. Besides water, if the fibers contain volatile matter, it may evaporate and contaminate the heating medium in the heat treatment chamber 23. Accordingly the content of the heating medium is changeable depending on the operating conditions. In this case it is necessary to exhaust a part of the heating medium and at the same time supply a component or components of the heating medium, for keeping constant the rate of the components. For getting stable effect of heat-treatment, the conditions of the heating medium recirculated into the high-pressure portion 34 of the heat-treatment chamber 23 should be controlled as to be constant, concerning temperature, pressure and ratio of components. Preferably the energy contained in the heating medium to be exhausted should be recovered.

With the apparatus 43 thus constructed, the heating medium used for heat treatment of the fibers 21 in the chamber 23 flows from the low-pressure portion 35 through the orifice 46 into the low-pressure treatment chamber 44 where the heating medium is mixed up with the above said hot medium blew into through the duct 30 and a heating medium supplied thereinto via the control valve 42. The heating medium is pressurized and then heated as it is recirculated from the low-pressure treatment chamber 44 into the high-pressure portion 34 of the heat-treatment chamber 23 via the pressurizing unit 40 and the heater 41. The valve 46 may also be connected with the pressurizing unit 40, so as to lead the return flow of the heating medium directly to it.

The moisture contained in the fibers evaporates in the heat-treatment chamber 23 and the quantity of steam in the chamber tends to increase. A part of the steam leaks through the inlet and outlet ducts 29, 30, other excess steam is discharged, the heat of which being recovered as explained hereinbelow.

Figure 6:
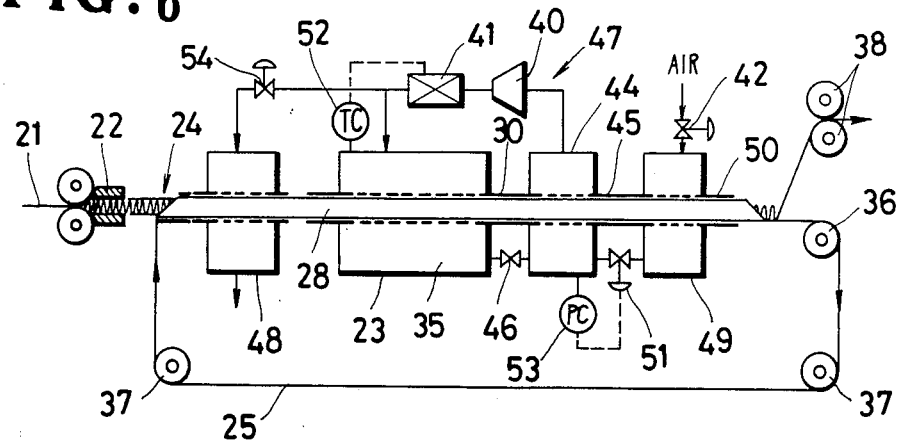
FIG. 6 is a view similar to FIG. 5, showing a modified apparatus suitable for a thermal treatment of fibers with heated dry air.

FIG. 6 shows an apparatus 47 in which dry air is used as a heating medium. The moisture in the fibers is removed by drying before entering into the heat-treatment chamber 23. The apparatus 47 is similar to the apparatus 43 of FIG. 5 but is different therefrom in that the recirculated heating medium is also supplied under pressure into a preheat chamber 48 disposed upstream of the heat-treatment chamber 23 for drying the fibers 21 before being treated in the chamber 23. The fibers 21 wrapped with the breathable heat resistant fabric 25 are thermally treated as they are passed through the chambers 23, 44 in the belt-like shaped object 28. Since the belt-like object 28 withdrawn from the chamber 44 is still hot, heat energy is reclaimed by bringing the belt-like object 28 into heat-exchange relationship with air so that the belt-like object 28 gives up its heat energy to the air thereby heating up the air. To this end, the apparatus 47 includes a cooling chamber 49 disposed downstream of the low-pressure treatment chamber 44 for cooling the belt-like object 28 by the air supplied thereinto via the control valve 42. The cooling chamber 49 is structurally the same as the chamber 44 and has an outlet duct 50 remote from the low-pressure treatment chamber's outlet duct 45 which serves as a connector duct joining the chambers 44, 49 together. The air in the cooling chamber 49 is maintained at a pressure higher than the pressure of the air in the low-pressure treatment chamber 44 so that cool air flows from the chamber 49 into the duct 45 to cool the fibers 21. The cooling chamber 49 is held in flow communication with the chamber 44 via a control valve 51. The cooling chamber 49 is not necessary where quenching of the fibers is not a major requirement and the calories contained in the fibers 21 is low and hence less effective to achieve an economical heat recovery. In such case, dry air may be supplied to a heating medium circulation system.

In order to maintain a constant treatment temperature, the apparatus 47 includes a temperature controller 52 disposed in the heat-treatment chamber 28 and operatively connected to the heater 41 to control operation of the heater 41 in response to the temperature in the chamber 23. The apparatus 47 further includes a pressure controller 53 disposed in the low-pressure treatment chamber 44 and operatively connected with the valve 42 or the valve to control the amount of supply of air into the heating medium circulation system. A valve 54 is a control valve 51 disposed between heating medium recirculation passage and the preheat chamber 48 for controlling the supply of air into the preheat chamber 48.

Figure 7:
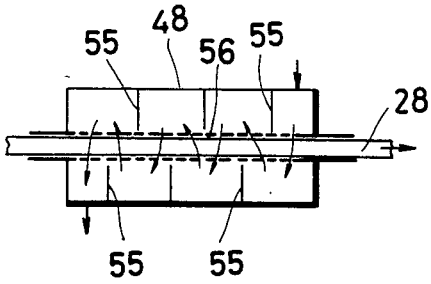
FIG. 7 is a schematic longitudinal cross-sectional view of a preheat chamber of the apparatus shown in FIG. 6.

The preheat chamber 48 may have a pair of series of buffle plates 55 disposed on the opposite sides of a guide channel 56 in staggered relation to one another, as shown in FIG. 7. With this arrangement, the heating medium or dry air is deflected by the baffle plates 55 to flow across the belt-like shaped object 28 several times, thereby preheating the fibers 21 efficiently and uniformly. the pressurizing unit 40 preferably comprises a blower or a turboblower. An air ejector may be used when a large amount of air is used up in the preheat chamber 48.

Figure 8:
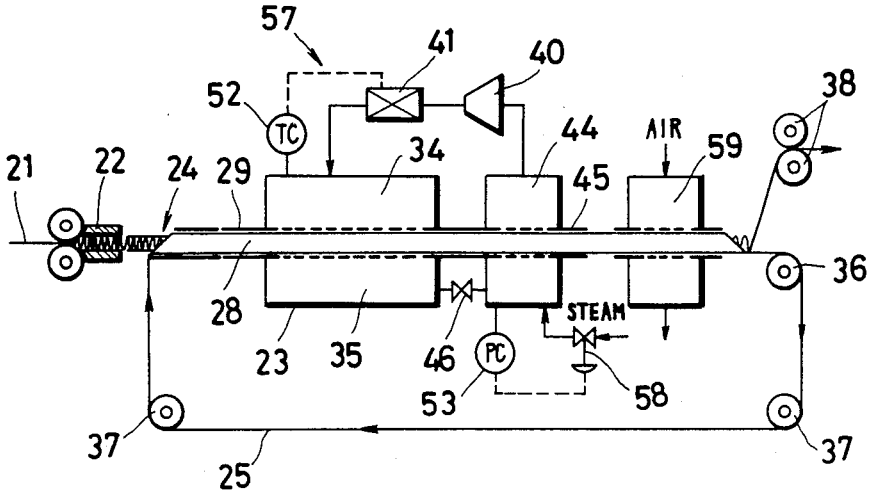
FIG. 8 is a view similar to FIG. 6, showing another modified apparatus in which superheated steam is used for treating fibers with a relatively low moisture content.

A modified apparatus 57 shown in FIG. 8 is particularly suitable for the thermal treatment of fibers with a relatively low moisture content, using superheated steam as a heating medium. The apparatus 57 is similar to the apparatus 43 shown in FIG. 5 but differs therefrom as described below. In order to prevent intrusion of the external air into the heat treatment chamber 23, a small amount of superheated steam must be discharged from the inlet and outlet ducts 29, 45. In case the amount of leaked steam is larger than the moisture content of the fibers 21 to be treated, the corresponding amount of steam is supplied into the low pressure treatment chamber 44 through a control valve 58. Unlike the apparatus 47 shown in FIG. 6, a cooling chamber 59 is separated from the low-pressure treatment chamber 44. The supplied steam is heated by the heater 41 before being supplied into the heat-treatment chamber 23 therefore either saturated steam or wet steam may be supplied through the valve 58. In the case where the dry state is required even in the chamber 44, superheated steam is supplied into the chamber 44. As an alternative, saturated or wet steam is supplied directly to the heater 41. The pressurizing unit 40 preferably comprises a blower or a turboblower.

Figure 9:
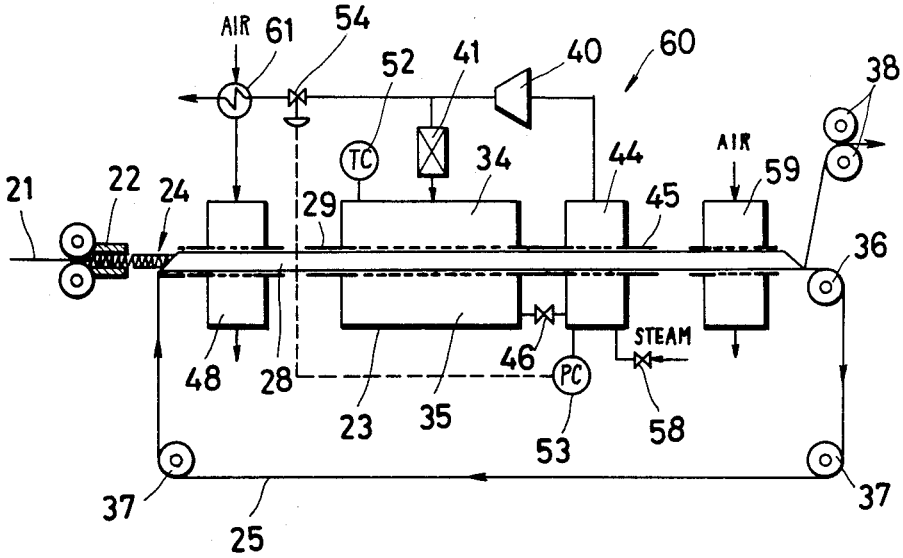
FIG. 9 is a view similar to FIG. 8, showing a modified apparatus in which superheated steam is used for treating fibers with a relatively high moisture content.

FIG. 9 shows a modified apparatus 60 which is suitable for thermally treating fibers with a relatively high moisture content, using a superheated steam as heating dedium. The moisture contained in the fibers evaporate in ther heat-treatment chamber and the quantity of steam in the chamber tends to increase. A part of the steam leaks through thge inlet and outlet ducts, other excess steam is discharged, heat of which being recovered explained hereunder. The apparatus 60 is substantially the same as the apparatus 47 of FIG. 6 with the exception that an excessive steam is discharged from the control valve 54 connected to the pressurizing unit 40 in parallel relation to the heater 41. The discharged steam is then introduced into a heat exchanger 61 in which the steam gives its heat to air supplied thereinto to thereby heat the same. The heated air is then supplied into the preheat chamber 48 the fibers before the latter is introduced into the heat-treatment chamber 23. The valve 54 operates under the control of the pressure controller 53. A blower or a turboblower is preferably used as the pressurizing unit 40 but a steam ejector may be used. The valve 54 may be disposed at a downstream position either of the heat-treatment chamber's low-pressure portion 35 or of the heater 41.

Figure 10:
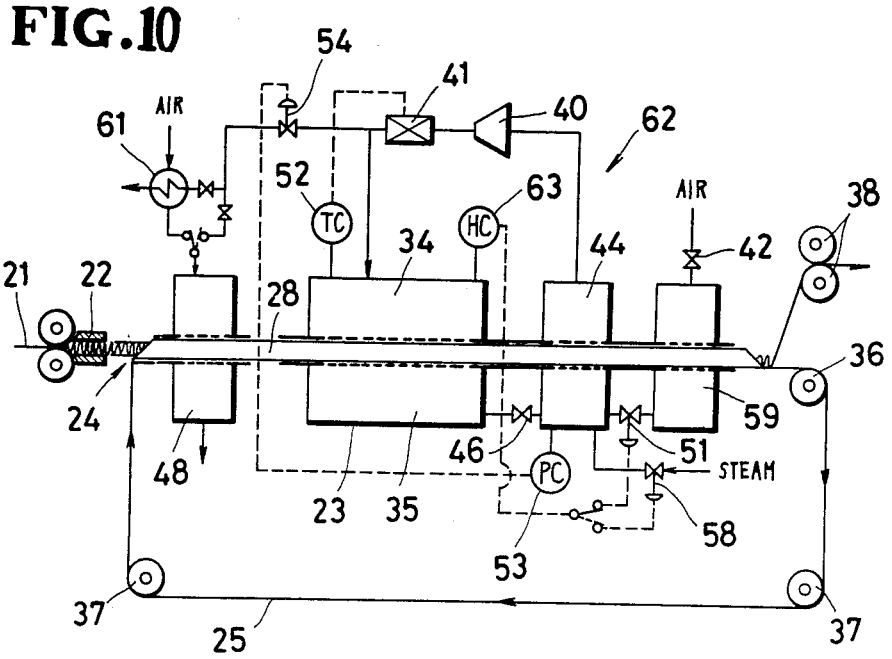
FIG. 10 is a schematic longitudinal cross-sectional view of a thermal treatment apparatus adapted to use an air-and-steam mixture as a heating medium.

FIG. 10 shows an apparatus 62 in which an air-superheated steam mixture is used as a heating medium. The apparatus 62 is substantially identical with the apparatus 60 shown in FIG. 9 excepting that it comprises a high temperature-moisture controller 63. The controller 63 is disposed in the heat-treatment chamber 23 and operatively connected with the control valves 51 or 58 for controlling the supply of air or steam to thereby maintain a constant ratio between the air and superheated steam in the heating medium. The pressurizing unit 40 comprises a blower, a burboblower, an air ejector, or a steam ejector.

Figure 11:
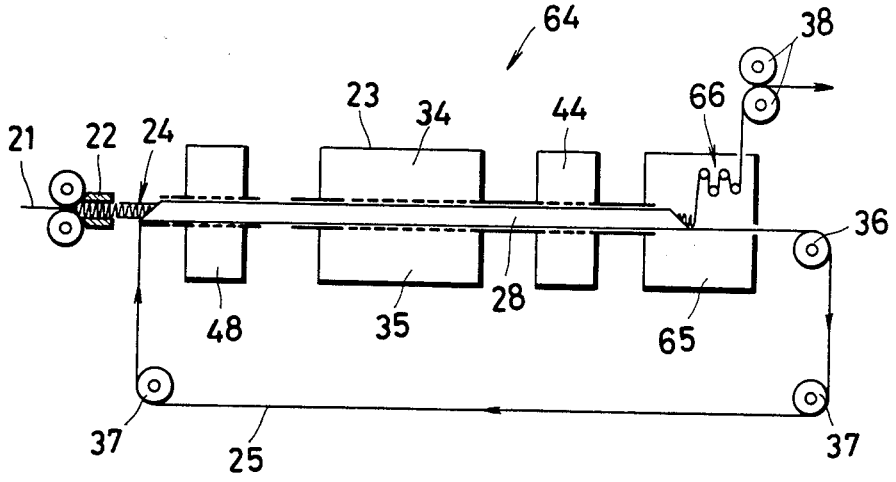
FIG. 11 is a view similar to FIG. 10, showing a still further modification according to the present invention.

An apparatus 64 illustrated in FIG. 11 includes means for relaxing crimp of the treated yarns. This means comprises a drawing chamber 65 disposed downstream of the low-pressure treatment chamber 44 and having a series of guid bars or rollers 66 each moving slightly faster than the previous one. The breathable heat resistant fabric 25 wrapped the fibers upto the chamber 65, is opened. The thermally treated fibers are taken out and elongated by passing them through the rollers 66. The degree of relaxation of crimp can be controlled by changing the temperature in the drawing chamber 65 and the resistance while passing through the guide bars on the speed differences between the rollers 66.

The method of thermally treating the fibers is explained more detail with reference to several experimental examples all of which were aimed to make the fibers shrinke approximately 10%.

EXAMPLE 1

A bundle of fibers of 500,000 denier (5 denin per filament) was prepared by melt spinning polyester into filaments and drawing them. The fibers were then treated with an oiling agent, the moisture content after oiling was 4%. The bundle of yarns was then processed by the apparatus 47 of FIG. 6. That is, the fibers were introduced first into the preheat chamber 48 and then into the heat-treatment chamber 23 into which dry air having a dew point of $-20^{C.}$ was supplied. The apparatus 47 was operated under such conditions that the high-pressure portion 34 of the heat-treatment chamber 23 was maintained at a pressure of 200 mmHg and at a temperature of 160° C., and the low-pressure portion 35 of the chamber 23 was mointained at a pressure of 100 mmHg. The bundle of fibers was advanced at a speed such that of the bundle was maintained in the chamber 23 for about 30 sec. The bundle of fibers thus treated was shrunk 11% compared with the initial length.

EXAMPLE 2

The bundle of yarns as used in Example 1 was processed by the apparatus 57 shown in FIG. 8 into which superheated steam of a temperature of 130° C. is supplied. The bundle was maintained in the heat-treatment chamber 23 for about one min. The treated bundle of yarns had a shrinkage of 11%.

EXAMPLE 3

The bundle of yarns as used in Example 1 was processed by the apparatus 62 shown in FIG. 10 into which a mixture of air and superheated steam of 20 wt% was supplied. The temperature of the heating medium in the heat-treatment chamber 23 was kept at $140^{C.}$, the bundle of the yarns wes maintained for about 30 sec. The obtained bundle of yarns had a shrinkage of 10%.

Although various minor modifications may be suggested by those versed in the art, it should be understood that we wish to embody within the scope of the patent warranted hereon, all such embodiments as reasonably and properly come within the scope of our contribution to the art.

What is claimed is:

1. In the method of continuous thermal treatment of a bundle or bundles of fibers fed longitudinally in a continuous cake form corrugated in advance, said method comprising the steps of: wrapping the continuous cake of the fibers with a breathable heat resistant fabric (25) to form a continuous belt-like shaped object (28); letting the belt-like shaped object (28) pass through at least one thermal treatment region (33) filled with a heating medium having a predetermined temperature and pressure for thermally treating the fibers through pressure seal portions (29, 30) each having a cross section substantially the same as the cross section of the belt-like shaped object (28); and unwrapping the cake of the fibers (21) from the breathable heat resistant fabric (25) to take out the fibers (21), the improvement which comprises filling said region with a heating medium which is non-condensable gas, superheated steam, or a mixture of said non-condensable gas and superheated steam, and a pressure difference is produced between the two ends of the said pressure seal portions (29, 30), and between the opposite sides of the passage of the belt-like shaped object in the said thermal treatment chamber (33), thereby causing said heating medium to flow (a) longitudinally along the belt-like shaped object (28) in opposite directions or (b) transversely across the belt-like shaped object (28) or both according to flow (a) and (b).

2. In an apparatus (20) for continuous thermal treatment of a bundle or bundles of fibers (21) withdrawn from a stuffer box (22) in a continuous cake form corrugated in advance, said apparatus comprising: means (24) disposed downstream of the stuffer box (22) for wrapping the continuous cake of the fibers (21) with a breathable heat resistant fabric (25) to form a continuous belt-like shaped object (28) having a substantially uniform cross section throughout the length thereof; a heat-treatment chamber (23) disposed downstream of said wrapping means (24) and including a pair of parallel spaced perforated partition walls (31, 32) defining therebetween a guide channel (33) for the passage of the belt-like shaped object (29); means (42, 58) for supplying a heating medium into said heat-treatment chamber (23) to heat the fibers (21); and a pair of ducts (29, 30) extending outwardly from the opposite ends of said guide channel (33) of the heat-treatment chamber (23) for the passage therethrough of the belt-like shaped object (28), said ducts (29,30) having a cross section substantially the same as the cross section of the belt-like shaped object (28) to provide pressure seal for the purpose of limiting the quantity of flow of the heating medium out of the channel and preventing intrusion of the outside air into said heat-treatment chamber (33) and the first one of said ducts corresponding to the inlet duct (29) of said heat-treatment chamber (33), the improvement wherein said heat-treatment chamber (23) is separated by said guide channel (33) into high-pressure portion (34) and the low-pressure portion (35) disposed on opposite sides of said guide channel, said heating medium comprises one of non-condensable gas, superheated steam, and a mixture of said non-condensable gas and said superheated steam, passage means is disposed outside said heat-treatment chamber for recirculating the heating medium from said low-pressure portion (35) to said high-pressure portion (34) of said heat-treatment chamber (23), and pressurizing and heating means (40, 41) is disposed in said passage means for pressurizing and heating the heating medium before the heating medium is recirculated into said high-pressure portion (34).

3. An apparatus according to claim 2, including means for detecting conditions of the heating medium in said heat-treatment chamber and operatively connected to said supply means for controlling the supply of the heating medium.

4. An apparatus according to claim 2, including a low-pressure treatment chamber connected to said second duct and held in fluid communication with said heat-treatment chamber for collecting therein the heating medium flowing through said second duct, said passage means being connected to said high-pressure portion of said heat-treatment chamber and said low-pressure treatment chamber.

5. An apparatus according to claim 2, including a preheat chamber disposed between said wrapping means and said heat-treatment chamber for preheating the fibers wrapped in the belt-like shape, said passage means including a branch passage connected with said preheat chamber for supplying a portion of the heating medium to be exhausted as surplus into said preheat chamber.

6. An apparatus according to claim 2, including a preheat chamber disposed between said wrapping means and said heat-treatment chamber for preheating the fibers wrapped in the belt-like shape, and a heat exchanger through which air to be supplied as a heating agent of said preheat chamber, being given heat from a portion of heating medium to be exhausted as surplus.

7. An apparatus according to claim 2, including a cooling chamber (59) for cooling the non-condensable component of the heating medium to ambient temperature at a pressure higher than the pressure of said low-pressure portion (35), said cooling chamber (59) being disposed downstream of said heat-treatment chamber (23) and being held in fluid communication with the latter, whereby said non-condensable component is fed to said low-pressure portion (35) to make up the heating medium or is discharged after having cooled the fibers (21) in said cooling chamber (50).

8. The method according to claim 1 wherein said thermal treatment region is divided into a high pressure portion and a low pressure portion and said heating medium is recirculated from said low pressure portion to said high pressure portion.

9. The method according to claim 1 wherein said heating medium is a mixture of air and superheated steam and said thermal treatment region contains a high temperature moisture controller for controlling the amount of air and steam and maintain a constant ratio between the air and superheated steam.

* * * * *